United States Patent [19]

Korsen

[11] Patent Number: 5,052,074

[45] Date of Patent: Oct. 1, 1991

[54] MAGNETIC PICK UP DEVICE FOR VACUUM CLEANER

[76] Inventor: David W. Korsen, 6053 Corporal La., Boise, Id. 83704

[21] Appl. No.: 646,837

[22] Filed: Jan. 28, 1991

[51] Int. Cl.[5] ..... A47L 9/00

[52] U.S. Cl. ..... 15/339; 209/215

[58] Field of Search ..... 15/339, 415.1; 209/215

[56] References Cited

U.S. PATENT DOCUMENTS

| | | | |
|---|---|---|---|
| 4,279,745 | 7/1981 | Haase | 15/339 X |
| 4,300,260 | 11/1981 | Hill | 15/339 |
| 4,759,095 | 7/1988 | Hoy | 15/339 |
| 4,904,376 | 2/1990 | Haase | 15/339 X |

*Primary Examiner*—Chris K. Moore

*Attorney, Agent, or Firm*—Paul F. Horton

[57] ABSTRACT

A magnetic pick up device for a vacuum cleaner, including a first elongated strip of magnetized material affixed to and along the front lower face of a vacuum cleaner housing and a second elongated strip of magnetized material magnetically held in place by the first strip. The second strip may be magnetically secured to the front face of the first strip to accumulate magnetic debris such as pins, staples, needles, screws, and the like, from the surface being vacuumed. The second strip is then simply pulled from the magnetic attraction of the first strip and the debris removed. In this manner, the first strip remains relatively free from debris. The second strip may also be magnetically attached to the bottom-most edge of the first strip for placement closer to the carpet or floor being cleaned for more powerful attraction with the debris. The strips are preferably constructed of flexible material and include beveled ends to minimize damage to furniture or other objects which may be contacted.

10 Claims, 1 Drawing Sheet

MAGNETIC PICK UP DEVICE FOR VACUUM CLEANER

BACKGROUND OF THE INVENTION

1. Field of the Invention

This invention relates, in general, to vacuum cleaners, and, more particularly, to magnetized elements attached to a vacuum cleaner for picking up magnetic debris.

2. Description of the Prior Art

It is highly desirable that metallic objects, such as pins, needles, screws, and other magnetic debris be removed from the path of a vacuum cleaner to prevent potential damage to the cleaner and to prevent potential injury to those in the immediate area who might be struck by such debris flung from the rotor of the cleaner. Also, such objects may be of value and thereby saved from being swept into the vacuum bag.

To this end, a number of devices have been created for attachment to existing vacuum cleaners, as typified by U.S. Pat. Nos. 2,288,115, issued to C. S. Soldanels; 2,677,461, issued to E. J. Bodey; 2,862,224, issued to A. S. Swanson et al; 4,006,512, issued to S. Saulson; 4,279,745 issued to G. Haase; 4,300,260 issued to C. Hill; 4,598,439, issued to J. Good; and 4,759,095, issued to H. Hay, Jr.

Problems common to known devices include bulkiness of the device, thereby preventing close edge cleaning; inconvenient attachment to existing cleaners; difficulty in removing and disposing of magnetic material collected; and inability to conveniently change the distance between the magnetic collector and the surface being cleaned.

SUMMARY OF THE INVENTION

The present invention overcomes all of these problems in providing a magnetic pick up device for vacuum cleaners; said device including a first elongated strip of magnetized material readily installed on an existing vacuum cleaner by means of an adhesive strip; and a second strip of magnetized material held to the first strip by magnetic attraction.

It is, therefore, a general object of the present invention to provide a magnetic pick up device for vacuum cleaners which is easily attachable; trim; and provides magnetic debris removal with a minimum of effort.

More specifically, it is an object of the present invention to provide a magnetic pick up device for vacuum cleaners which utilizes a first strip of magnetized material to temporarily hold a second strip of magnetized material, upon which magnetic debris collects for easy removal.

It is another object of the present invention to provide a magnetic pick up device for vacuum cleaners which may be easily and conveniently flipped to and from a position closer to the floor.

Additional objects and advantages will become apparent and a more thorough and comprehensive understanding may be had from the following description taken in conjunction with the accompanying drawings forming a part of this specification.

DETAILED DESCRIPTION OF THE INVENTION

Figure 1:
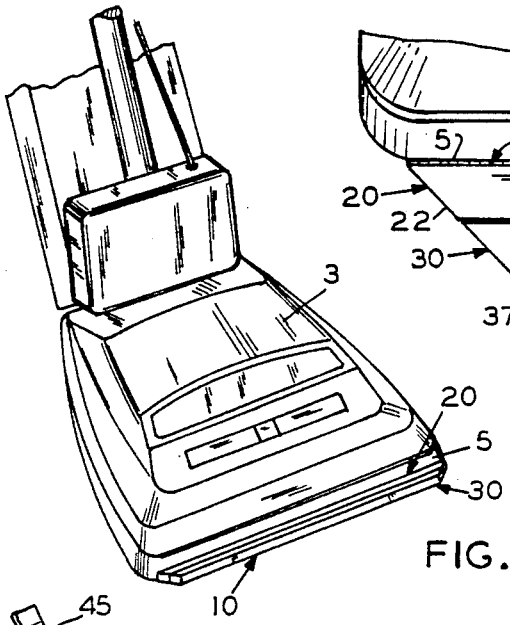
FIG. 1 is a perspective view showing attachment of the magnetic pick up device of the present invention to a vacuum cleaner.
Figure 4:
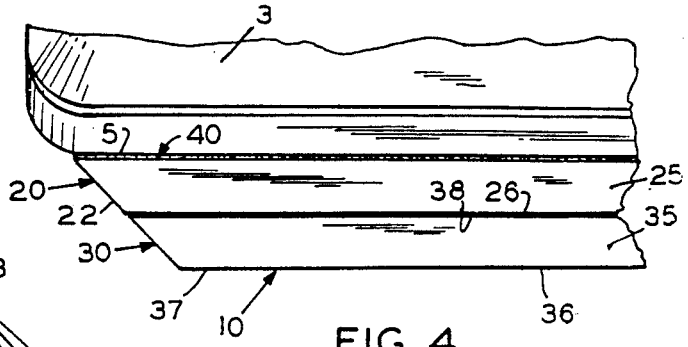
FIG. 4 is a plan view, in partial section, showing the mode of attachment of FIG. 3.

Referring now to the drawings, and, more particularly to FIGS. 1 and 4, an embodiment to be preferred of a magnetic pick up device 10, made according to the present invention is disclosed, as mounted to a vacuum cleaner 3. Device 10 includes, generally, a first magnetic strip 20; a second magnetic strip 30; and first strip attachment means, designated generally by the numeral 40.

Figure 2:
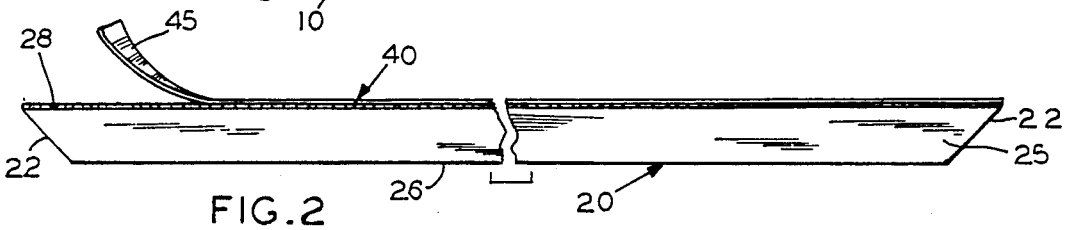
FIG. 2 is a plan view of the first magnetic strip.

Referring to FIG. 2, first strip 20 may be seen to advantage. First strip 20 is preferably constructed of flexible material, such as rubber, Neoprene, or common plastics interspersed with ferromagnetic or ferrimagnetic permanently magnetized material. In being flexible, attachment to the vacuum cleaner and especially, curved portions of the vacuum cleaner housing, if any, is facilitated. The strip may be of any suitable length, 11.25 inches being a standard length, and, in the preferred embodiment, is rectangular in cross-section, having a depth of one-half inch and a width of one-quarter inch, to define a front face 26; a rear face 28; a top edge 25; and a bottom edge 27. End members 22 are beveled, as shown, to reduce frictional impact with objects which it might engage, such as furniture.

Although first strip 20 may be attached to vacuum cleaner 3 by any conventional means, such as nuts and bolts, it is preferred that it be attached by means of an adhesive strip 40. For shipping purposes, adhesive strip 40 is covered by a paper or plastic strip 45, shown in FIG. 2, which may simply be peeled from the adhesive strip for mounting. First strip 20 is mounted to the front face 5 of the vacuum cleaner 3, across the lowermost edge of the face so as to be parallel with and spaced above the floor, carpet, or other surface being cleaned.

Figure 3:
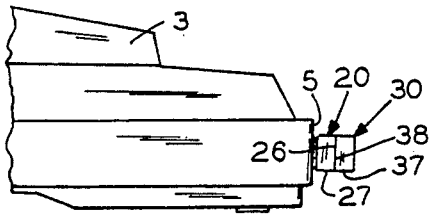
FIG. 3 is a side view of the magnetic pick up device of FIG. 1, showing one mode of attachment of the second magnetic strip to the first magnetic strip.

The second elongated strip 30 of magnetized material is also preferably flexible and constructed of like material to first strip 20 and is also rectangular in cross-section, having the same depth and width as will hereinafter be more fully explained. Like the first strip 20, second strip 30 defines a front face 36; a rear face 38; a top edge 35 and a bottom edge 37. In order that the beveled edges be in alignment when magnetically attached to first strip 20, as shown in FIG. 3, and to further advantage in FIG. 4, the length of strip 30 is about one-half inch less than the length of the first strip.

Figure 7:
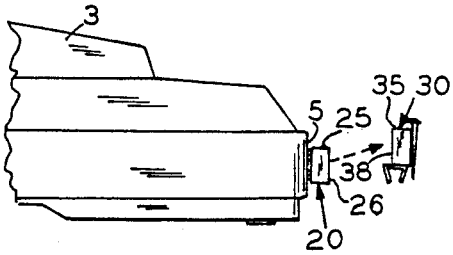
FIG. 7 is a side view of the device of FIG. 1, showing separation of the magnetic strips, as for removal of magnetic debris.

The second strip 30 may be magnetically connected to the first strip 20 in two different modes. In the first mode, shown in FIGS. 3 and 4, the second strip is magnetically affixed in horizontal stacked relationship with the first strip with the rear face 38 of the second strip engaging the front face 26 of the first strip. In this mode, any magnetic debris is highly likely to be attracted to and be held in place on second strip 30 in that the second strip, by such positioning relative to the first strip, is at the forwardmost end of the vacuum cleaner and in that greater surface area is presented to the debris. For disposing of the magnetic debris, the second strip is simply pulled from the magnetic attraction of the first strip, as shown in FIG. 7, and, still holding the debris because of its own magnetism, is taken to a refuse can where the debris may be cleanly scraped or skidded from the second strip. The strip is then replaced for further use.

Figure 6:
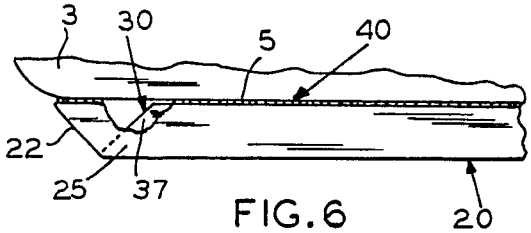
FIG. 6 is a plan view, in partial section, showing the mode of attachment of FIG. 5 with the underlying second magnetic strip being shown in outline.
Figure 5:
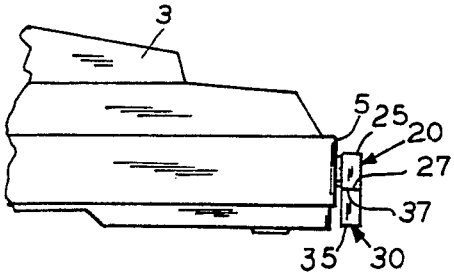
FIG. 5 is a side view of the magnetic pick up device of FIG. 1, showing a second mode of attachment of the second magnetic strip to the first magnetic strip for closer placement to the floor.

In a second mode, shown in FIGS. 5 and 6, second strip 30 is positioned below first strip 20 in a reversed position with "bottom" edge 37 now engaging the bottom edge 27 of first strip 20. Reversal is necessary because of the magnetic polarity of the two strips. To go to the second mode from the first mode, second strip 30 may be completely removed and then replaced, or, as shown in FIG. 5, second strip 30 may simply be flipped downwardly from the first mode position, shown in FIG. 3, to underlie the first strip, with the corners of the two strips acting as a magnetic hinge. When placed in the second mode, second strip 30 is in closer apposition to the carpet or floor being cleaned and, because of such positioning, attracts most of the magnetic debris. For cleaning the debris from the second strip 30, the strip is simply pulled from the magnetic attraction of the first strip, as before indicated.

Having thus described in detail a preferred selection of embodiments of the present invention, it is to be appreciated and will be apparent to those skilled in the art that many physical changes could be made in the apparatus without altering the inventive concepts and principles embodied therein. The present embodiments are therefore to be considered in all respects as illustrative and not restrictive, the scope of the invention being indicated by the appended claims rather than by the foregoing description, and all changes which come within the meaning and range of equivalency of the claims are therefore to be embraced therein.

I claim:

1. A magnetic pick up device for a vacuum cleaner comprising:

a first elongated strip of magnetized material attachable to and along the front lower face of a vacuum cleaner housing;

attachment means for connecting said first strip to said housing; and a second elongated strip of magnetized material, said second strip held to said first strip by magnetic attraction and said second strip operable to pick up magnetic debris and to be magnetically detachable from said first strip for removal of the debris.

2. The magnetic pick up device as described in claim 1, wherein said attachment means comprises an adhesive strip affixed to said first strip.

3. The device as described in claim 1 wherein each of said strips of magnetized material are substantially rectangular in cross-section, having a front face, rear face, top edge and bottom edge, and wherein said second strip is magnetically attachable to said first strip with the rear face of said second strip engaging the front face of the first strip to increase the effective thickness of the device and wherein said second strip is magnetically attachable to the bottom edge of said first strip to increase the effective depth of the device.

4. The device as described in claim 3, wherein each of said magnetized strips are constructed of flexible material.

5. The device as described in claim 3 wherein each of said strips are provided with beveled end members to reduce contact between said end members and objects impacted thereby.

6. A magnetic pick up device for vacuum cleaners comprising:

a first elongated strip of magnetized material for attachment to a front lower surface of a vacuum cleaner housing, said strip having a rear face engageable with said housing, a front face, a top edge and a bottom edge, and opposing end members; and a second elongated strip of magnetized material, provided with a rear face, a front face, top and bottom edge and opposing end members, said second strip magnetically attractable to said first strip with the rear face of said second strip engaging the front face of said first strip for accumulation of magnetic debris on said second strip and said second strip magnetically detachable from said first strip for removal of the debris.

7. The device as described in claim 6 wherein said second strip is magnetically attachable to said first strip in reversed orientation with the bottom edge of said second strip in magnetic engagement with the bottom edge of the first strip to increase the effective depth of the device for closer engagement between the device and a surface being vacuumed.

8. The device as described in claim 6 wherein opposing ends of said first strip and said second strip are each beveled to lessen contact between the strips and objects impacted thereby.

9. The device as described in claim 6 wherein each of said strips are constructed of flexible material.

10. The device as described in claim 6 further comprising an adhesive strip mounted on the rear face of said first strip for attachment of said strip to a vacuum cleaner housing.

* * * * *